US008414458B2

(12) United States Patent
Hsieh

(10) Patent No.: US 8,414,458 B2
(45) Date of Patent: Apr. 9, 2013

(54) STRENGTH TRAINING CONTROL APPARATUS USING MOTOR ASSEMBLED S-TYPE LOAD CELL

(75) Inventor: Li-Min Hsieh, Taoyuan County (TW)

(73) Assignee: Chi Hua Fitness Co., Ltd., Taoyuan County (TW)

( * ) Notice: Subject to any disclaimer, the term of this patent is extended or adjusted under 35 U.S.C. 154(b) by 147 days.

(21) Appl. No.: 13/109,057

(22) Filed: May 17, 2011

(65) Prior Publication Data

US 2012/0231929 A1 Sep. 13, 2012

(30) Foreign Application Priority Data

Mar. 11, 2011 (TW) ..... 100204357 U

(51) Int. Cl.
*A63B 21/005* (2006.01)

(52) U.S. Cl.
USPC ..... 482/5; 482/4; 482/6

(58) Field of Classification Search ..... 482/1–9, 482/79, 92–94, 98–100, 133–138, 142; 601/23, 601/33–35
See application file for complete search history.

(56) References Cited

U.S. PATENT DOCUMENTS

| | | | | |
|---|---|---|---|---|
| 4,635,933 | A * | 1/1987 | Schnell | 482/7 |
| 5,186,695 | A * | 2/1993 | Mangseth et al. | 482/6 |
| 5,618,250 | A * | 4/1997 | Butz | 482/137 |
| 5,813,864 | A * | 9/1998 | Ikuta | 434/253 |
| 6,368,251 | B1 * | 4/2002 | Casler et al. | 482/4 |
| 6,689,075 | B2 * | 2/2004 | West | 601/23 |
| 7,931,573 | B2 * | 4/2011 | Shinomiya et al. | 482/142 |
| 2007/0004567 | A1 * | 1/2007 | Shetty et al. | 482/69 |
| 2010/0331144 | A1 * | 12/2010 | Rindfleisch | 482/6 |

* cited by examiner

*Primary Examiner* — Loan Thanh
*Assistant Examiner* — Shila Jalalzadeh Abyane
(74) *Attorney, Agent, or Firm* — Rosenberg, Klein & Lee

(57) ABSTRACT

A strength training control device comprises: a torque source (including a base frame, a motor and a gear reduction box); and a link mechanism (including a gearbox arm, a first link rod, a second link rod, and an operating rod arm), wherein a S-type load cell is coupled to the first link rod and the second link rod to sense a load value. The control device further comprises: an operating rod, an electronic meter for setting a torque value, and a servo controller for comparing a load value of S-type load cell with a set value of the electronic meter. After the difference value is adjusted, an electric current is outputted to drive the motor, and the motor torque is amplified by the gear reduction box and transmitted through the link mechanism to the operating rod, and users can obtain a torque value equal to the setting of the electronic meter.

8 Claims, 6 Drawing Sheets

STRENGTH TRAINING CONTROL APPARATUS USING MOTOR ASSEMBLED S-TYPE LOAD CELL

BACKGROUND OF THE INVENTION (a) Field of the Invention

The present invention relates to a strength training control device using a motor assembled S-type load cell, and more particularly to a servo device that uses an S-type load cell for feeding back a load value and a servo controller and comparing the load value with a set value and adjusting the load value to drive a motor, such that the exercise load can be equal to the set torque value.

(b) Description of the Related Art

In addition to a base frame and a link mechanism, exercise equipments or fitness machines for strength training generally come with a resistance device for providing an exercise load. With reference to FIGS. 1 and 2 for perspective views of a stretch trainer as disclosed in U.S. Pat. No. 7,396,319, the fitness machine of this sort comprises: a stretching part 12 disposed at the front of a seat 11 and provided for pressing a user's thighs 121 and calves 122 together; a movable inward/outward direction switch part 13 disposed at the bottom of the fitness machine, and a resistance arrangement 14 disposed on a lateral side of the fitness for providing a resistance to the load, and linked with the movable inward/outward direction switch part 13 by a cable 15. If a user's thighs and calves drive the stretching part 12 towards the interior or exterior to link the movable inward/outward direction switch part 13, then the resistance arrangement 14 will provide the exercise load to the user.

In general, the conventional resistance arrangement 14 is composed of a plurality of weights 141 stacked on top of one another and used as the exercise load, but the conventional way of providing a load has the following drawbacks:

1. The weights 141 usually come with a large volume and occupy much space, and users have to add or remove the weights 141 to adjust the exercise load, not only wasting time and efforts, but also failing to continue the exercise while making the adjustment. As a result, it is difficult to achieve the expected exercise effect.

2. The load including the weights 141 is heavy and difficult to make adjustment, and users cannot have a continuous and smooth variable load according to a set curve, and thus causing an ineffective exercise effect and incurring a potential risk of muscle injuries.

3. When the load including the weights 141 is lifted to ascend and released to descend by a transmission cable 15, a very loud sound will be produced, not only distributing others, but also irritating the exerciser. Furthermore, the transmission cable 15 must be operated with components such as a winch pulley, and thus the structure of the fitness machine becomes more complicated.

The load device of the conventional fitness machine 10 has the aforementioned drawbacks and obviously requires improvements.

Some of the conventional exercise equipments or fitness machines adopt the motor torque as a resistance control of the exercise load, and an optical chopper is linked to the motor shaft, and an optical coupler is installed at its periphery to constitute an exercise stroke sensor used for controlling the electric current of a motor and used as a curve load to achieve a purpose of successful fitness. However, the optoelectronic mechanism has a relatively large volume and takes much installation space, and it also has the disadvantages of a relatively low precision, a relatively poor durability and a relatively high manufacturing cost, so that the optoelectronic mechanism cannot be used extensively by users.

SUMMARY OF THE INVENTION

Therefore, it is a primary object of the present invention to provide a load device for strength training equipments, which uses the torque of a motor shaft to substitute traditional weights to simplify the structure of the strength training equipments, not only reducing the weight and volume of the equipments significantly, but also enhancing the silent effect.

Another object of the present invention is to integrate the accurate sensing function of an S-type load cell to feed back a load value to a control device, correct the difference, and drive a motor to achieve the desired exercise load.

A further object of the present invention is to provide a way of setting a continuous and smooth variable load by users to achieve the best strength training effect.

In order to achieve the above-mentioned objects, the invention includes:

a) a base frame;

b) a torque source, fixed onto the base frame, and comprising a motor and a gear reduction box, wherein the motor is a brushless motor or a DC motor, and an end of the gear reduction box is coupled to the motor, and another end of the gear reduction box includes a main shaft;

c) an operating rod, with the bottom pivotally coupled to the base frame;

d) a link mechanism, having an output end coupled to a main shaft of the gear reduction box and an input end coupled to the operating rod, and the link mechanism having:

i) a gearbox arm, with an end sheathed on the main shaft, and another end coupled to a first link rod;

ii) an operating rod arm, with an end sheathed on the operating rod, and another end coupled to a second link rod; and iii) an S-type load cell, with both left and right sides coupled to the first link rod and the second link rod respectively;

e) an electronic meter, fixed onto the base frame, and provided for a user to set a required torque value; and f) a servo controller, for comparing the difference between a sensed value of the S-type load cell and a set value of the electronic meter and after the difference value is adjusted, an electric current is output to drive the motor;

whereby, after the motor torque is increased by the gear reduction box and then transmitted through the gearbox arm, the first link rod, the S-type load cell, the second link rod and the operating rod arm to the operating rod, the user obtains a torque value equal to the set value of the electronic meter.

DETAILED DESCRIPTION OF THE PREFERRED EMBODIMENT

Figure 6:
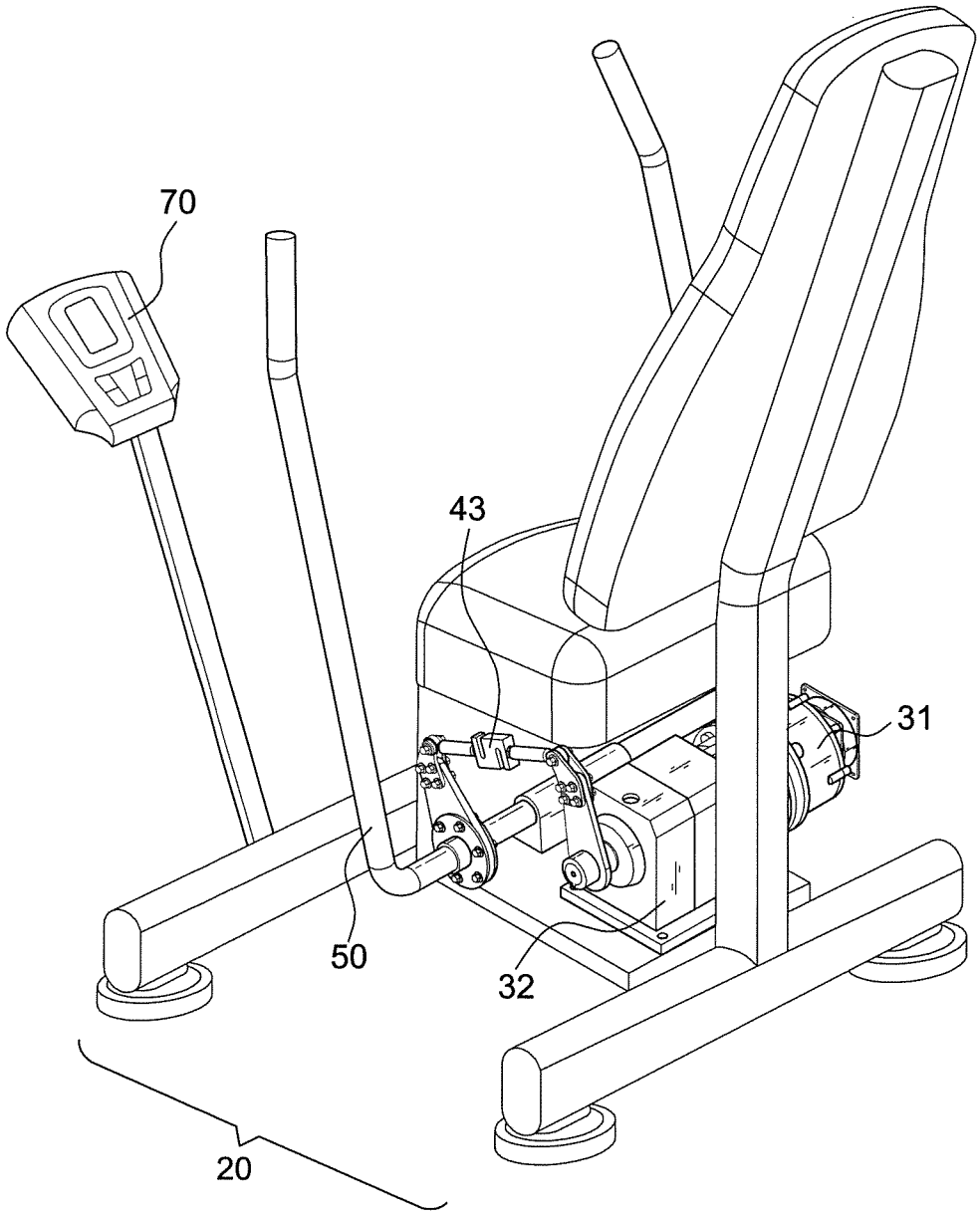
FIG. 6 is a perspective view of a preferred embodiment of the present invention applied in a fitness machine.

With reference to FIGS. 3 to 6 for a preferred embodiment of the present invention, this preferred embodiment comprises the following elements:

A base frame 20 comprises a plurality of hollow rods for installing components of the present invention, wherein the base frame is applicable for exercise equipments or medical equipments having reciprocating movements. In this preferred embodiment as shown in FIG. 6, the present invention is applied to equipments with reciprocating movements, but the present invention is not limited to such application only.

A motor 31 is a brushless motor or a DC motor for producing a load required by a linear movement of the exercise equipment.

A gear reduction box 32 with an end coupled to a shaft of the motor 31 has different sized gears, and a retardation ratio is produced by the different number of teeth of the different sized gears to increase the torque value outputted from the motor 31. The gear reduction box 32 comprises a base 321 disposed at the bottom of the gear reduction box 32 and secured onto the base frame 20 by screws, and the gear reduction box 32 further comprises a main shaft 322 disposed at another end opposite to the end coupled to the motor 31 for transmitting the increased torque value, and the main shaft 322 may have a key slot and use a key to transmit the torque. In this preferred embodiment, a square key 323 is formed directly on the main shaft 322 for coupling passive components.

An operating rod 50 comprises a right rod 51 and a left rod 52; two flanged bases 54, each being separately assembled to ends of the right rod 51 and the left rod 52 by an interference fit; and a rod holder 53, fixed onto the base frame 20 by screws or soldering, and containing an assembly for pivotally turning the rod, wherein the right rod 51 is passed through the rod holder 53, such that the operating rod 50 can be fixed to the base frame 20 and pivotally turned on the rod holder 53.

A link mechanism 40 has an end acting as an output end and coupled to the gear reduction box 32 and another end acting as an input end and coupled to the operating rod 50. The link mechanism comprises: a gearbox arm 41, a first link rod 42, an S-type load cell 43, a second link rod 44, and an operating rod arm 45. The gearbox arm 41 comprises a shaft hole 411 formed at the bottom of the gearbox arm 41; a connecting sleeve 33, with an external diameter slightly smaller than the shaft hole 411, wherein the connecting sleeve 33 is installed into the shaft hole 411 by an interference fit; the connecting sleeve 33 has a penetrating central hole 331 with a diameter slightly greater than the main shaft 322, and the central hole 331 contains a key slot 332 corresponding to the square key 323 of the main shaft 322 for sheathing the connecting sleeve 33 on the main shaft 322, such that the gearbox arm 41 can drive and rotate the main shaft 322. The gearbox arm 41 further comprises four first bolt holes 412 formed thereon; two first cams 46, having four second bolt holes 461 formed at the bottom of each first cam 46 and corresponding to the first bolt holes 412 respectively, and four first bolts 61 and four first nuts 62 are used for fixing the gearbox arm 41 with the two first cams 46 securely.

The operating rod arm 45 has six fifth bolt holes 451 formed at the bottom of the operating rod arm 45, and six sixth bolt holes 542 formed on a flange surface 541 of each of the two flanged bases 54 and corresponding to the fifth bolt holes 451 respectively, and six third bolts 65 and six third nuts 66 are used for fixing the flanged base 54 with the operating rod arm 45 securely, such that the operating rod arm 45 can be driven and rotated by the operating rod 50.

The operating rod arm 45 comprises four first bolt holes 452 formed at the top of the operating rod arm 45; two second cams 47, each having four second bolt holes 471 formed at the bottom of each of the second cams 47 and corresponding to the first bolt holes 452 respectively, and four first bolts 61 and four first nuts 62 are used for fixing the operating rod arm 45 with the two second cams 47 securely.

The S-type load cell 43 has a screw hole 431 formed separately on both sides of the S-type load cell 43, and screw threads 422, 442 are formed at ends of the first link rod 42 and the second link rod 44 and corresponding to the screw holes 431 respectively, and each spring washer 67 is installed separately between the S-type load cell 43 and the first link rod 42 and the second link rod 44, such that the screw threads 422, 442 can be locked into the screw hole 431 with a better fit.

The first link rod 42 includes a third bolt hole 421 formed at another end opposite to the screw thread 422, and each of the two first cams 46 has a fourth bolt hole 462 formed at the top of each first cam 46 and corresponding to the third bolt hole 421, and one second bolt 63 and one second nut 64 are used for fixing the two first cams 46 with the first link rod 42 securely.

The second link rod 44 includes a third bolt hole 441 formed at another end opposite to the screw thread 442, and each of the two second cams 47 has a fourth bolt hole 472 formed at the top of each second cam 47 and corresponding to the third bolt hole 441, and one second bolt 63 and one second nut 64 are used for fixing the two second cams 47 with the second link rod 44 securely.

Therefore, the torque produced by the motor 31 is retarded by the gear reduction box 32 to increase the torque value, and the torque is transmitted through the gearbox arm 41, the first cam 46, the first link rod 42, the S-type load cell 43, the second link rod 44, the second cam 47 and the operating rod arm 45 to the operating rod 50. Thus, a user can operate the operating rod by hands or legs, and the muscles of the user's hands or legs bear the torque produced by the motor and a torque value is increased by the gear reduction box the motor. In other words, the user operates the operating rod back and forth, and the motor produces a torque through the gear reduction box to produce the load resistance for the strength training.

An electronic meter 70 is fixed onto the base frame 20 and provided for users to set a desired torque value for the strength training. To improve the training effect, the invention can set a constant exercise load or set a continuous smooth variable exercise load.

Figure 1:
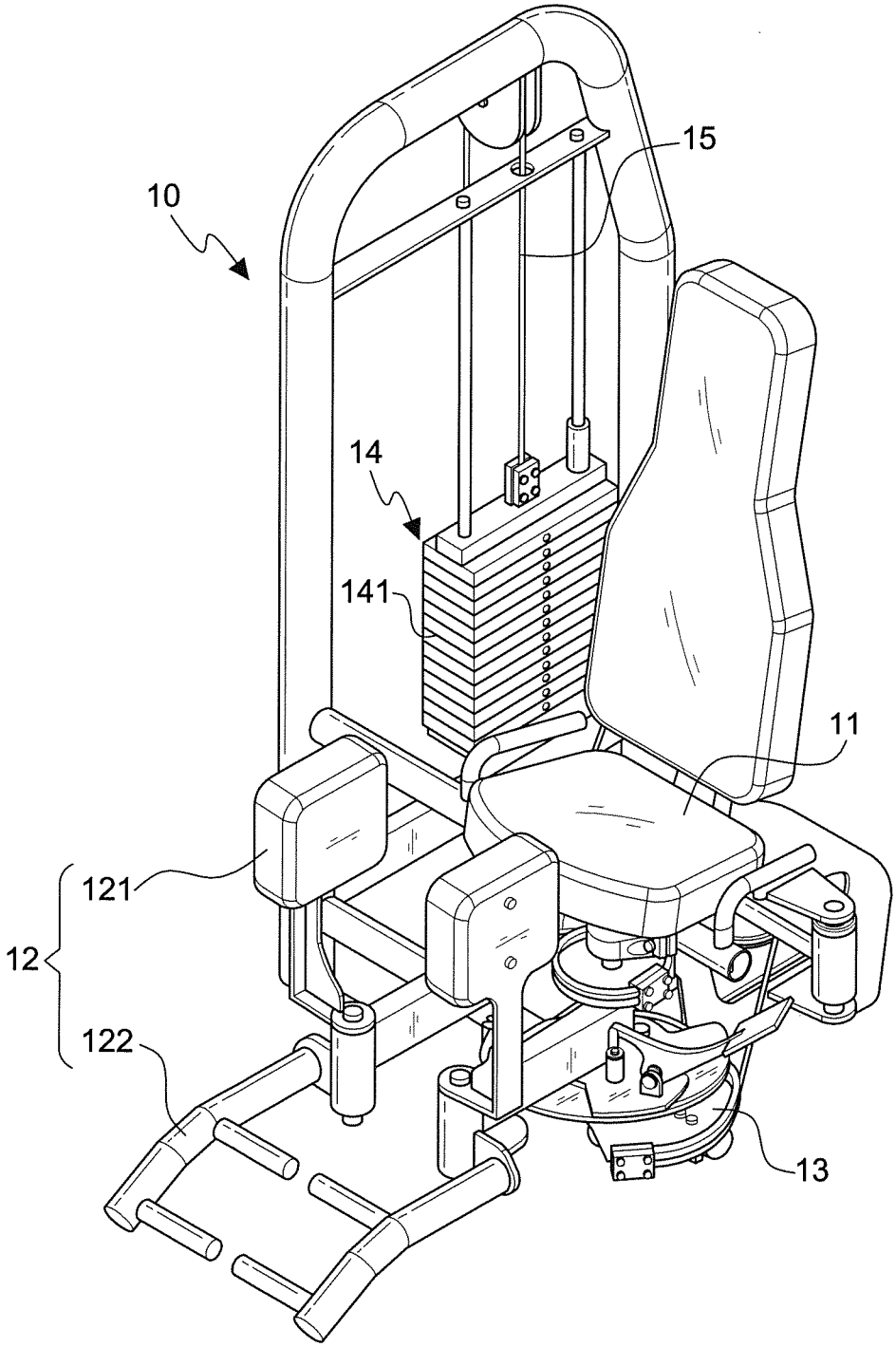
FIG.1 PRIOR ART
FIG. 1 is a first perspective view of a stretch trainer as disclosed in U.S. Pat. No. 7,396,319.
Figure 2:
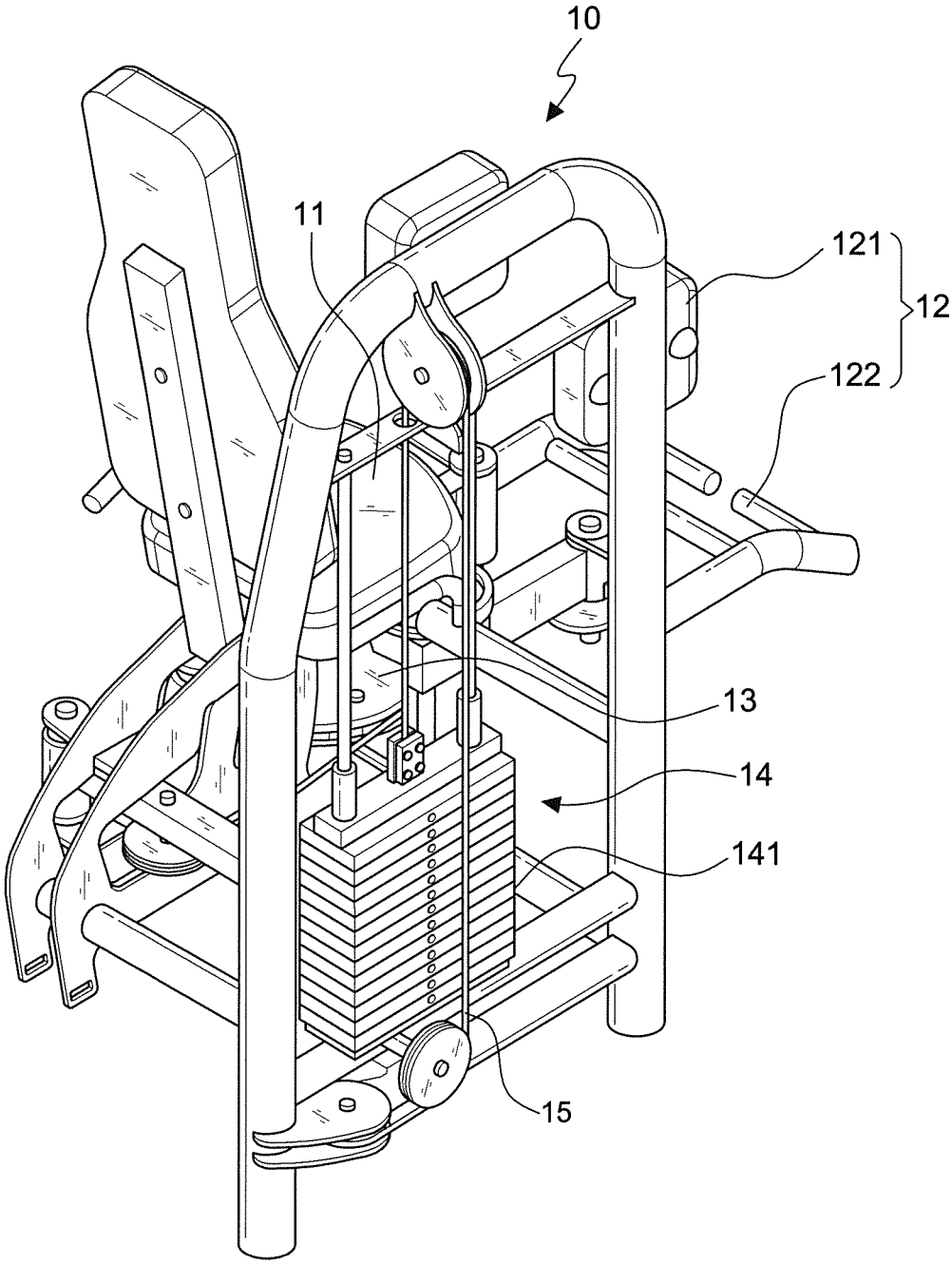
FIG.2 PRIOR ART
FIG. 2 is a second perspective view of a stretch trainer as disclosed in U.S. Pat. No. 7,396,319.
Figure 3:
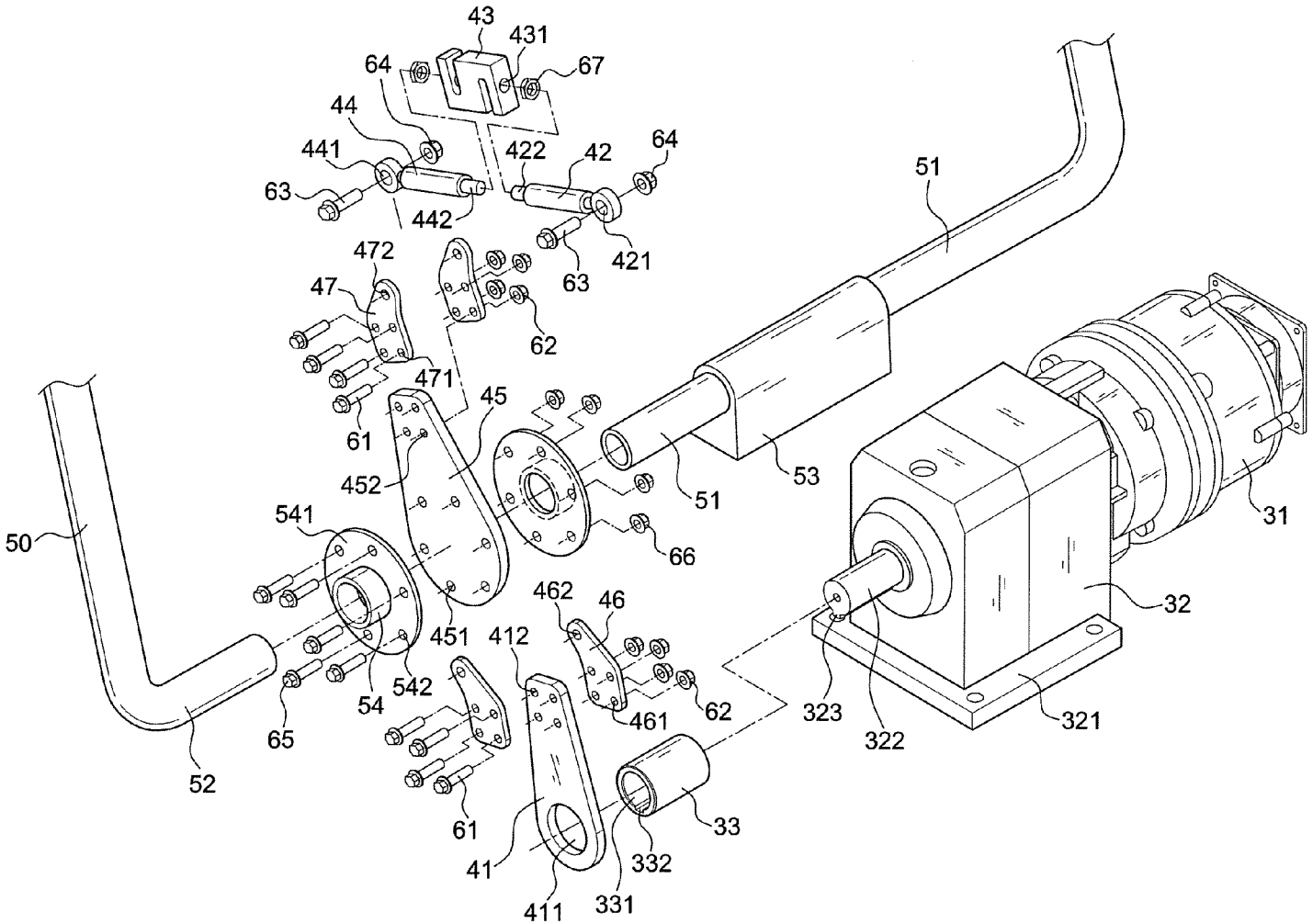
FIG. 3 is an exploded view of a preferred embodiment of the present invention.
Figure 4:
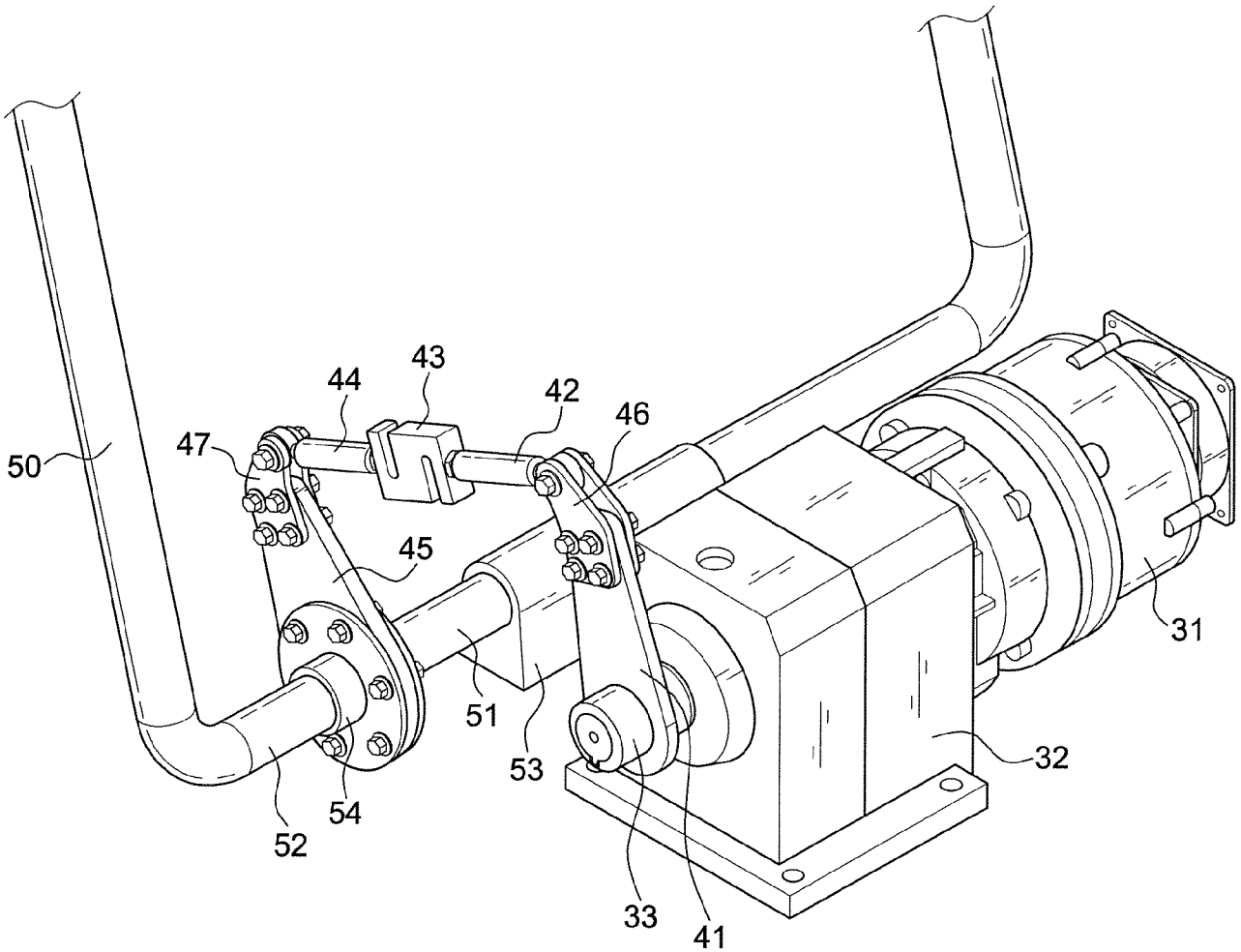
FIG. 4 is a perspective view of a preferred embodiment of the present invention.
Figure 5:
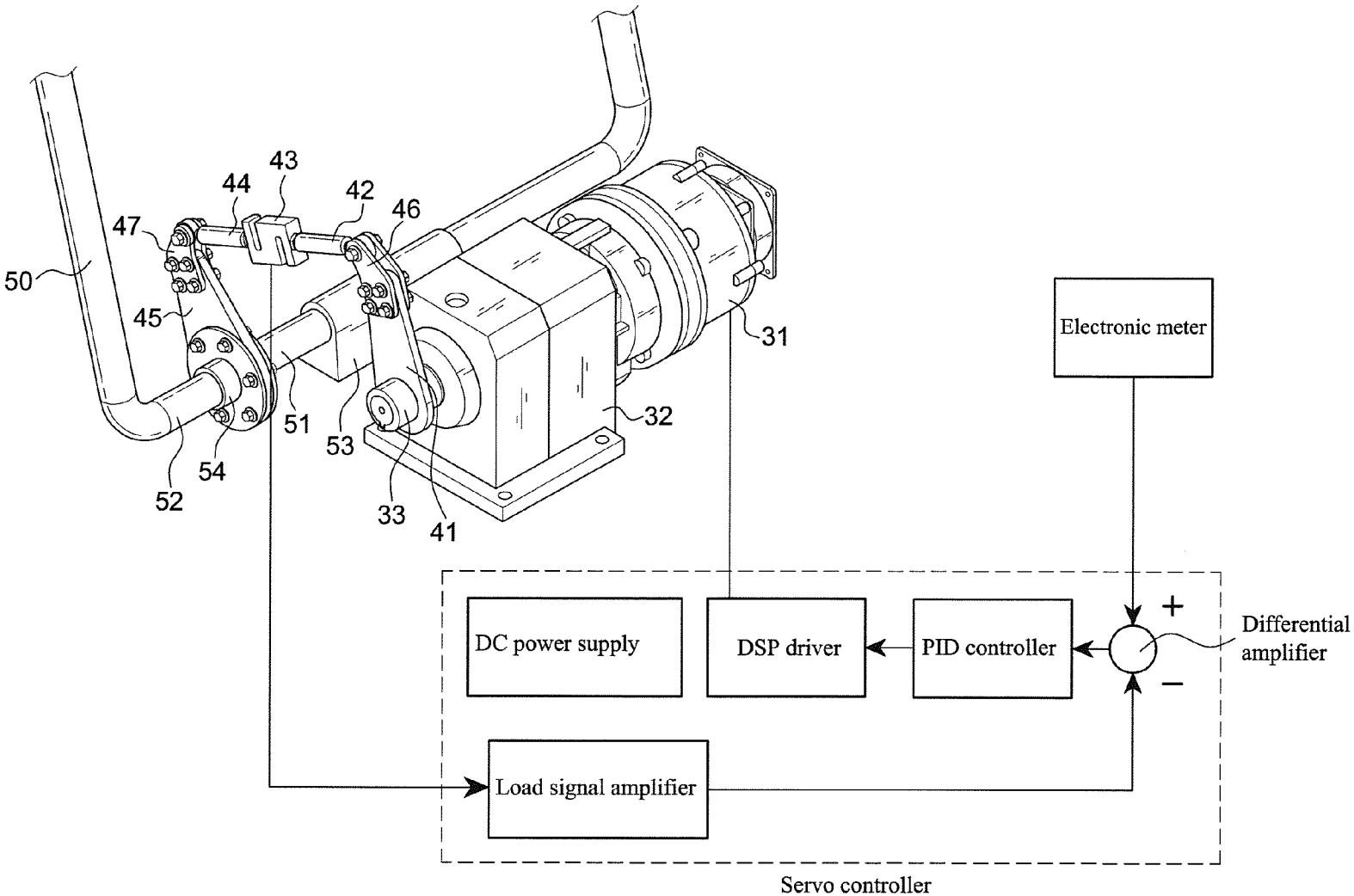
FIG. 5 is a circuit block diagram of the present invention.

A servo controller is primarily provided for comparing the difference between a sensed value of the S-type load cell 43 and a set value of the electronic meter 70. After the difference value is adjusted by the electric current controller, an electric current is outputted to drive the motor 31. The circuit block diagram of the servo controller as shown in FIG. 5 includes a DC power supply, a load signal amplifier, a differential amplifier, a proportional-integral-derivative (PID) controller, and a DSP driver, and the sensed value of the S-type load cell 43 is fed back to the load signal amplifier, and an amplified signal is transmitted to the differential amplifier. In addition, the set value of the electronic meter 70 is transmitted to the differential amplifier. Therefore, the differential amplifier compares the load signal of the S-type load cell at the actual end with a desired value set by the electronic meter at a target end, and the difference value of the desired value and the target value is adjusted by the PID controller to drive the DSP driver to output an electric current to drive the motor, so that the servo controller will compare the difference between the actual load and the target setting from time to time, and correct the difference to output an electric current to drive the motor, such that the actual exercise load can be equal to the set value.

In summation of the description above, the present invention integrates a motor, a gear reduction box, a controller, a torque sensor and an electronic meter into a servo control system electromechanically and uses the resistance as the exercise load to substitute the traditional weights. The invention can be applied extensively in various strength training equipments with the advantages of a simple structure, a convenient operation, and a continuous benefit.

The present invention integrates the low-cost S-type load cell with the link rod and arm to substitute the high-priced rotary type torque sensor, and the reliable durability and precision are not only applicable for general strength training, but also applicable for medical high-precision applications.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A strength training control device using a motor assembled S-type load cell, comprising:

a) a base frame;

b) a torque source, fixed onto the base frame, and comprising a motor and a gear reduction box, wherein the motor is a brushless motor or a DC motor, and an end of the gear reduction box is coupled to the motor, and another end of the gear reduction box includes a main shaft;

c) an operating rod, with the bottom pivotally coupled to the base frame;

d) a link mechanism, having an output end coupled to the main shaft of the gear reduction box and an input end coupled to the operating rod, and the link mechanism having:

i) a gearbox arm, with an end sheathed on the main shaft, and another end coupled to a first link rod;

ii) an operating rod arm, with an end sheathed on the operating rod, and another end coupled to a second link rod; and iii) an S-type load cell, with both left and right sides coupled to the first link rod and the second link rod respectively;

e) an electronic meter, fixed onto the base frame, and provided for a user to set a required torque value; and f) a servo controller, for comparing the difference between a sensed value of the S-type load cell and the set value of the electronic meter and after the difference value is adjusted, an electric current is output to drive the motor; whereby, after the motor torque is increased by the gear reduction box and then transmitted through the gearbox arm, the first link rod, the S-type load cell, the second link rod and the operating rod arm to the operating rod, the user obtains a torque value equal to the set value of the electronic meter.

2. The strength training control device using a motor assembled S-type load cell as recited in claim 1, wherein the servo controller comprises: a DC power supply, a load signal amplifier, a differential amplifier, a proportional-integral-derivative (PID) controller, and a DSP driver, and the sensed value of the S-type load cell is fed back to the load signal amplifier, and the signal is amplified and then transmitted to the differential amplifier, and the set value of the electronic meter is transmitted to the differential amplifier, and then after the differential amplifier compares the difference between the load value and the set value, the difference value is adjusted by the PID controller to drive the DSP driver to output an electric current to drive the motor.

3. The strength training control device using a motor assembled S-type load cell as recited in claim 2, wherein the S-type load cell has a screw hole separately formed on both left and right sides of the S-type load cell, a screw thread is respectively formed at ends of the first link rod and the second link rod and corresponding to the respective screw hole, and a spring washer is respectively installed between the first link rod and the S-type load cell and between the second link rod and the S-type load cell for a better fit of the screw thread and the screw hole.

4. The strength training control device using a motor assembled S-type load cell as recited in claim 1, wherein the gearbox arm and the main shaft are sheathed and coupled with each other by a connecting sleeve.

5. The strength training control device using a motor assembled S-type load cell as recited in claim 1, wherein the operating rod is divided into left and right rods, an end of each of the left and right rods being tightly sheathed with a respective flanged base, and the operating rod arm is installed between the two flanged bases and securely fixed by a plurality of bolt-and-nut sets, such that the operating rod arm swings reciprocally together with the operating rod.

6. The strength training control device using a motor assembled S-type load cell as recited in claim 1, wherein the gearbox arm and the first link rod are coupled by two first cams and securely fixed by a plurality of bolt-and-nut sets.

7. The strength training control device using a motor assembled S-type load cell as recited in claim 1, wherein the operating rod arm and the second link rod are coupled by two second cams and securely fixed by a plurality of bolt-and nut sets.

8. The strength training control device using a motor assembled S-type load cell as recited in claim 1, further comprising a rod holder for pivotally coupling the operating rod to the base frame.

* * * * *